US011243037B2

(12) United States Patent
Skerl et al.

(10) Patent No.: US 11,243,037 B2
(45) Date of Patent: Feb. 8, 2022

(54) FIREARM ALTERNATOR

(71) Applicants: Stephen Skerl, Houston, TX (US); Tomislav Skerl, Houston, TX (US)

(72) Inventors: Stephen Skerl, Houston, TX (US); Tomislav Skerl, Houston, TX (US)

( * ) Notice: Subject to any disclaimer, the term of this patent is extended or adjusted under 35 U.S.C. 154(b) by 107 days.

(21) Appl. No.: 15/844,426

(22) Filed: Dec. 15, 2017

(65) Prior Publication Data

US 2021/0018286 A1 Jan. 21, 2021

Related U.S. Application Data

(60) Provisional application No. 62/498,107, filed on Dec. 15, 2016.

(51) Int. Cl.
*F41A 21/32* (2006.01)
*F41C 27/00* (2006.01)
*F41A 19/60* (2006.01)

(52) U.S. Cl.
CPC ..... *F41A 19/60* (2013.01); *F41A 21/32* (2013.01); *F41C 27/00* (2013.01)

(58) Field of Classification Search
CPC .... F41A 35/00; F41A 19/60; F41A 21/30–38; F41C 27/00
See application file for complete search history.

(56) References Cited

U.S. PATENT DOCUMENTS

| | | | | |
|---|---|---|---|---|
| 3,257,905 | A * | 6/1966 | Weisman | F42D 1/04 89/1.1 |
| 3,973,500 | A * | 8/1976 | Brede | F42C 11/04 102/209 |
| 6,461,752 | B1 * | 10/2002 | Leung | H01M 8/065 429/421 |
| 6,744,154 | B2 * | 6/2004 | Leitner-Wise | H02K 7/1869 290/1 R |
| 7,525,203 | B1 * | 4/2009 | Racho | H02K 7/1876 290/1 R |
| 8,686,576 | B1 * | 4/2014 | Smith | F03G 7/08 290/1 R |
| 10,180,309 | B1 * | 1/2019 | Burke | H01Q 1/526 |
| 10,408,579 | B1 * | 9/2019 | Foltz | F41H 13/0075 |
| 2016/0356567 | A1 * | 12/2016 | Bybee | F41C 23/16 |
| 2018/0266784 | A1 * | 9/2018 | Guy | F41A 35/00 |
| 2019/0003803 | A1 * | 1/2019 | Kapogianis | F41G 9/00 |

* cited by examiner

*Primary Examiner* — Gabriel J. Klein
(74) *Attorney, Agent, or Firm* — Sheridan Ross P.C.

(57) ABSTRACT

Methods and apparatus are described for extracting and storing electrical energy from the gaseous discharge of a firearm. In one embodiment a muzzle device is provided comprising of at least one thermoelectric generator which generates electric power, to be stored in a battery, using heat transferred from the gaseous discharge of a firearm to the thermoelectric generator by a heat sink.

26 Claims, 7 Drawing Sheets

FIREARM ALTERNATOR

CROSS-REFERENCE TO RELATED APPLICATION

Applicant claims priority for this application to U.S. Provisional Patent Application Ser. No. 62/498,107 filed on Dec. 15, 2016 that is entitled "Firearm Alternator", an entire copy of which is incorporated herein by reference, unless there is a direct conflict with the disclosure herein, and in such case the disclosure herein shall take precedence.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

BACKGROUND OF THE INVENTION

1. Field of the Invention

The present disclosure is generally related to the extraction of electrical energy from hot gasses, primarily in the firearm industry. In addition, the present disclosure also relates to a new type of portable electric generator that may be used in many similar or analogous applications.

2. Description of Related Art Including Information Disclosed Under 37 CFR 1.97 and 1.98

Typically batteries may be used to power electronic devices attached to or a part of firearms. Here, the battery provides the electric potential necessary to power these electronic devices using a chemical reaction.

In practice there are two kinds of batteries: disposable and rechargeable. In disposable batteries the chemical reaction that provides power irreversibly changes its reactants; when these reactants are used up, the battery stops producing electricity and is useless.

In rechargeable batteries the chemical reaction that provides power reversibly changes its reactants; when these reactants are used up and the battery stops producing power, in this case however, a current can be applied to the rechargeable battery to reform its reactants. Once the reactants are reformed the battery is again able to supply power.

All batteries, both disposable and rechargeable, are subject to self-discharge while not in use. This is due to the occurrence of inevitable side reactions. Self-discharge is particularly problematic for battery powered electronics that see only sporadic use like electronic firearms accessories. This is because a battery can lose its charge while not in use, becoming unable to provide power the next time a person tries to use it.

An alternative to batteries is the generation of electrical power locally using electrical generators attached to firearms. These generators seek to harness the kinetic energy of a firearm's projectile, the mechanical energy of automatic firearm operation, or the thermal energy imparted to components of a firearm during its normal operation.

In practice projectile based generators have undesirable hidden costs. Projectile based generators require the use of projectiles with magnetic properties (U.S. Pat. No. 3,257,905). Standard ammunition lacks these magnetic properties which means anyone wishing to use a projectile based generator must buy new, more expensive, ammunition.

Other projectile based generators seek to extract kinetic energy from projectiles by impeding their travel (U.S. Pat. No. 2,822,664). While this method does not necessitate specialized ammunition, it removes so much kinetic energy from the projectile that the firearm the generator is attached to can no longer serve as a gun.

Mechanically based generators, unlike projectile based generators, function with standard ammunition since they extract energy from the mechanical action of an automatic firearm (U.S. Pat. No. 7,525,203). In practices though these mechanically based generators can only function when installed on automatic firearms. This makes mechanically based generators useless for manually operated firearms.

Thermal based generators require no specialized ammunition, or a specific type of firearm. Thermal based generators draw energy from the heat radiated by parts of a firearm during its operation (U.S. Pat. Nos. 6,461,752; and 8,783,154). Typically thermal based generators use the barrel of a firearm as their source of heat. In practice this system operates at very low efficiency until the barrel heats up. Hot barrels affect the accuracy and physical integrity of a firearm. Additionally hot barrels are uncomfortable for the firearm operator that must be near and/or hold them. In practice a thermal based generator works against its user as it works only with a hot firearm, which is undesirable to its user. Additionally the efficiency of thermal based generators relies on a favorable ambient temperature, a factor outside of a user's control.

SUMMARY OF THE INVENTION

An object of embodiments of the present disclosure is to provide a reliable source of electrical energy for electronic devices attached to or a part of firearms.

Another object of embodiments of the present disclosure is to provide a reliable source of electrical energy for electronic devices that are independent from, but in the presence of, a firearm.

Another object of embodiments of the present disclosure is to provide a reliable source of electrical energy for electronic devices attached to or a part of firearms that does not need to be recharged.

Another object of embodiments of the present disclosure is to provide a reliable source of electrical energy for electronic devices attached to or a part of firearms that does not need a specialized projectile.

Another object of embodiments of the present disclosure is to provide a reliable source of electrical energy for electronic devices attached to or a part of firearms that does not need specialized ammunition.

Another object of embodiments of the present disclosure is to provide a reliable source of electrical energy for electronic devices attached to or a part of firearms that does not compromise the function of a firearm.

Another object of embodiments of the present disclosure is to provide a reliable source of electrical energy for electronic devices attached to or a part of firearms that does not need to be attached to automatic firearms.

Another object of embodiments of the present disclosure is to provide a reliable source of electrical energy for electronic devices attached to or a part of firearms that operates efficiently at all temperatures.

Another object of embodiments of the present disclosure is to provide a reliable source of electrical energy for electronic devices attached to or a part of firearms that operates efficiently at all barrel temperatures.

The Summary of the Invention is neither intended nor should it be construed as being representative of the full extent and scope of the present invention. Moreover, reference made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention.

BRIEF DESCRIPTION OF THE SEVERAL VIEWS OF THE DRAWING(S)

The accompanying drawings, which are incorporated in and constitute a part of the specification, illustrate embodiments of the invention and together with the general description of the invention given above and the detailed description of the drawings given below, serve to explain the principles of these inventions.

Figure 1:
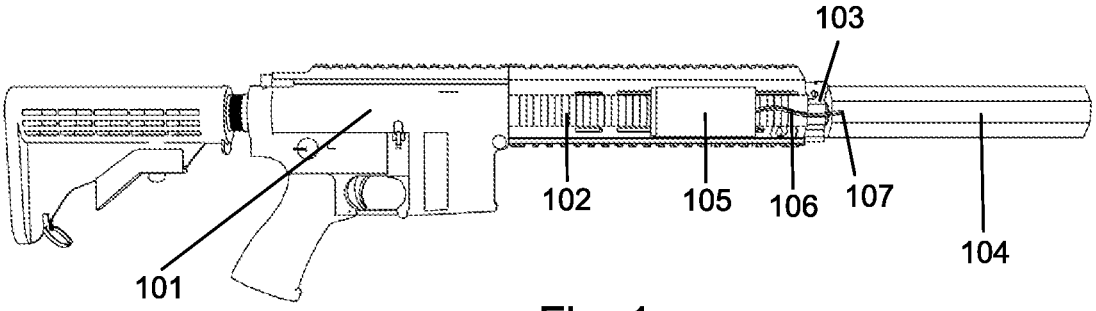
FIG. 1 is a side view of a rifle with a Mark I Firearm Alternator mounted.

To assist in the understanding of one embodiment of the present invention the following list of components and associated numbering found in the drawings is provided herein:

101—Firearm
102—NATO standard rail system
103—Threaded barrel
104—Alternator
105—Battery box
106—Battery box connecting wire
107—Plug for Battery box wire
201—Tubular housing
202—Front end cap
203—Back end cap
204—Set of mesh disks
205, 206, 207—Finned aluminum mounting plates
208, 209, 210—Thermoelectric generators
211, 212, 213—Mounting recesses and slits for finned aluminum mounting plates
301—Alternator exhaust
302—Alternator intake
303—Mesh disks
304—Insulating Alternator housing
305, 306, 307—Finned aluminum mounting plates
308, 309, 310—Thermoelectric generators
401—Mesh disk
402—Mesh disk central hole
403—Mesh disk dorsal slit
404—Finned aluminum mounting plate
405—Thermoelectric generator
501—Mesh disk
502—Front blade of aluminum mounting plate fin
503—Finned aluminum mounting plate
504—Thermoelectric generator
601—Battery box housing
602—USB port
603—Control buttons
604—NATO standard rail mounting system
605—Alternator connecting wire
606—Laser
607—Flashlight
701—Front Alternator end cap
702—Ultra-capacitor cutaway
703—Battery cutaway
704—Ring of LEDs
801—Finned radiator
802—Radiator sleeve
803—Exposed radiator air intake
804—Firearm Alternator muzzle
805—Sleeve overhang It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

SPECIFICATION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Preferred embodiments of The Mark I have one Firearm Alternator. Various embodiments of The Mark I have one or more Firearm Alternators.

A preferred embodiment of the Firearm Alternator utilizes a heat exchanger of bronze mesh and an electric generator that is of a thermoelectric type. The Alternator includes a heat sink, insulating housing, one or more thermoelectric generators and an electric load.

In one or more preferred embodiments, the Alternator should not exceed 0.75 inches in the vertical when measuring from the central bore axis. This is consistent with a cylinder with a diameter of 1.5 inches. The Alternator should have a length between 6 to 7 inches. The Alternator should have be around 20 ounces give or take 3 ounces in total weight.

In one or more embodiments, there may be one or more alternators.

In one or more preferred embodiments, the heat sink will be composed of a stack of bronze thirty-mesh tin plated bronze disks. The disk will each have a central 0.234 inch diameter hole for the passage of a projectile. Each disk will have radial slit(s) cut into them to allow direct contact with a thermoelectric generator mounting. Disks will be stacked together to fill a cylindrical volume.

In one or more preferred embodiments, the thermoelectric generator will be mounted to an aluminum plate of equal size. The aluminum plate will have a central downward rectangular protrusion like a sailboat's keel. This protrusion (contact fin) will make physical contact with the mesh heat exchanger via the radial slits cut into the mesh disks.

In one or more preferred embodiments, the housing will internally house the mesh heat sink. Slits should be cut into the housing at thermoelectric generator mounting points to allow the contact fins to enter the housing's internal volume and touch the heat sink. The housing should thermally insulate the heat sink from the environment.

Should the device be deemed overweight when entirely filled with heatsink disks, the housing will have two chambers split by a solid dividing wall. The first chamber (nearest the rifle) is a sealed expansion chamber, the housing of which is lined with a protective mesh lining that acts as a heatsink. The second chamber is the heatsink chamber and is filled with the mesh heatsink disks. The expansion chamber serves to preserve internal volume without going overweight. Ideally there would be no expansion chamber and just a heatsink, weight restrictions may limit us however, requiring the addition of a mostly empty chamber.

In one or more preferred embodiments, connected to the thermoelectric generator is an ultra capacitor or battery. Since the firearm to which a firearm alternator is attached cannot be relied on to fire continuously a battery or ultra-capacitor will store the bursts of energy.

Upon the discharge of the firearm to which the firearm alternator is attached, a projectile passes from the muzzle of the firearm into the firearm alternator. Behind the projectile follows the gaseous discharge of the firearm. The projectile passes safely through the central hole of the mesh disks that make up the heatsink. The gaseous discharge behind the projectile expands into the volume occupied by mesh disks, radiating heat into the mesh. The heat in the mesh radiates into the aluminum projections of thermoelectric generator mountings, heating the thermoelectric generator. The thermoelectric generator then uses the heat gradient to generate electricity. The electricity is then stored in either a battery or an ultra-capacitor which can be discharged to power an electronic device like an LED or rifle sight.

An example of bronze mesh for use as a heat exchanger in embodiments of the Mark I Firearm Alternator is 30 Mesh Bronze 0.012 sold by TWP, Inc. 2831 Tenth St., Berkeley, Calif., 94710 (part number 030X030PC0120W36T DK).

An example of a thermoelectric generator for use in embodiments of the Mark I Firearm Alternator is the Seebeck Thermoelectric Generator, part number 1261G-7L31-24CX1, sold by Custom Thermoelectric, 11941 Industrial Part Road, Suite 5, Bishopville, Md., 21813.

In one or more embodiments, a cooling radiator that may be attached to the Mark I Firearm Alternator to improve the efficiency of thermoelectric generators. In one or more embodiments, the radiator includes a finned heat sink and a tubular sleeve.

In a preferred embodiment, the heat sink has a radius of 1.00 inches when measured from the center axis to the tip of its radiator fins. The heat sink features a central hole with a 0.75 inch radius to accommodate the insertion of a Firearm Alternator into its center. The heat sink is the same length as the Firearm Alternator it surrounds, approximately 6 to 7 inches. A thin walled tubular sleeve also 6 to 7 inches in length fits around the heat sink/Firearm Alternator assembly. This tubular sleeve is mounted with a forward offset of 1.00 inch so that it overhangs the front of the heat sink/Firearm Alternator assembly and exposes a rear portion of the finned heat sink to the open air.

The overhang of the tubular sleeve allows the muzzle blast of Firearm Alternator to create a low pressure zone in front of the finned heat sink. This low pressure area draws cool air in from the exposed rear of the radiator. The drawn in air proceeds forward towards the muzzle of the Firearm Alternator cooling the heat sink fins. This in turn allows the heat sink to cool the thermoelectric generators of the Firearm Alternator.

This forced air cooling method works best in situations of sustained or rapid fire where the continued discharge of a firearm is able to maintain the low pressure zone in front of the radiator. In situations where sustained or rapid fire are not expected the tubular sleeve should be removed to allow the finned heat sink to radiate heat into the environment unencumbered.

In one or more embodiments, the electrical systems of the Mark I Firearm Alternator use a Hybrid Energy Storage System (HESS) of ultra-capacitor(s) and battery(s). In one or more embodiments, the electrical system includes, a thermoelectric generator, an ultra-capacitor, a lithium-polymer battery and an electrical load(s). Examples of possible electrical loads include a flashlight, a laser, an optical sighting system(s), charge port(s) for external devices (e.g., phone, radio, personal digital assistant, computer, etc.).

In a preferred embodiment, the thermal electric generators are expected to have a maximum output of around 5 Amps and 4 Volts providing approximately 20 watts when their hot side is 300° C. This output is expected to fluctuate greatly during firearm discharge. To compensate for this, a hybrid energy storage system consisting of ultra-capacitor(s) in parallel with lithium-polymer battery(s) will be used. This energy storage system will smooth the inconsistent output of the thermoelectric generator(s) increasing the robustness and efficiency of the Firearm Alternator electrical systems. To meet the needs of this system the ultra capacitor should be able to handle around 5 Volts.

Battery size is determined by the expected load. When the load is expected to be high a lithium polymer battery with a capacity of approximately 20 Watt-hours is used. For small loads a battery with a capacity of approximately 5 Watt-hours is used.

In one or more preferred embodiments, components of the electrical system, namely the battery, ultra capacitor and load are housed in a polymer "battery box" separate from the Firearm Alternator, this arrangement allows for better weight management by locating a large portion of the Firearm Alternator's total weight on an accessory rail system instead of the barrel of the firearm.

An alternative to the "battery box" arrangement is the "battery end cap". In this configuration the front end cap of the Firearm Alternator (the end cap that doesn't interface with the firearm barrel) is extended slightly. The battery and ultra capacitor are housed in the hollowed space between the inner and outer circular walls of the end cap. A small electrical load, suitable for a 5 Watt-hour, of LED lights and/or laser(s) are inset into the forward exposed face of the end cap. This configuration allows the Firearm Alternator and its electrical systems to be built and sold as a single small compact unit.

In one or more preferred embodiments, an ultra capacitor cell for use in embodiments of the Mark I Firearm Alternator may be a type PBLL, passively balanced ultra capacitor module with leads and connector, sold by the Tecate Group, 7520 Mission Valley Road, San Diego, Calif., 92108.

The Mark I Firearm Alternator is composed of two main components: the alternator 104 and the battery box 105 (FIG. 1). These components are attached separately to a firearm 101 using pre-existing mounting methods (FIG. 1). In one embodiment of the invention these methods are the mounting of the battery box 105 to a NATO standard rail mounting system 102 and the attachment of the alternator 104 using a threaded barrel 103 (FIG. 1). Once the components of the alternator 104, 105 are securely mounted to a firearm 101, they are connected by an electrical wire 106 which facilitates the transfer of electricity from the alternator 104 to the battery box 105 (FIG. 1).

Figure 2:
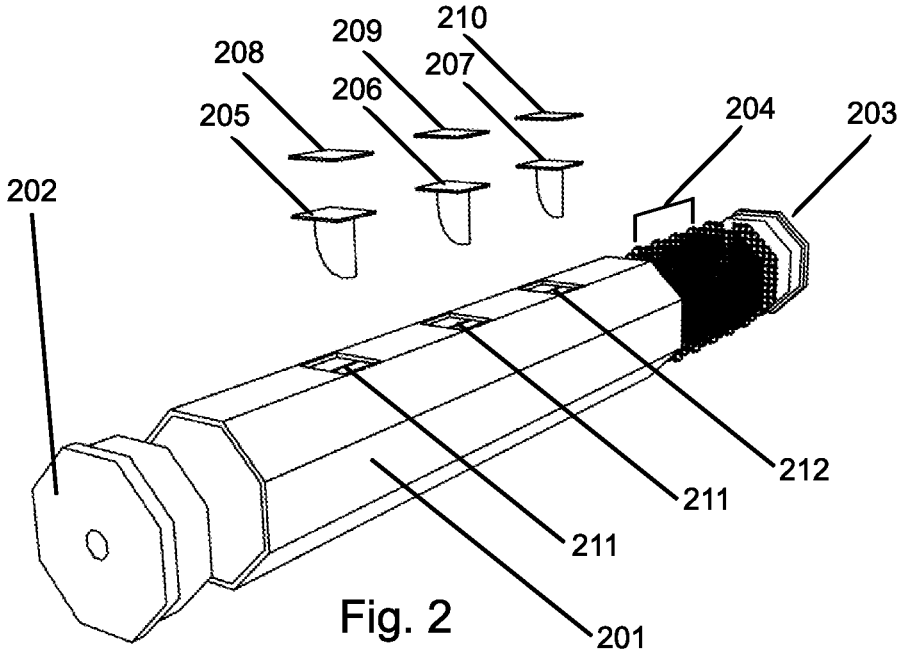
FIG. 2 is an exploded isometric view of the Mark I Firearm Alternator.

The alternator has an insulating housing consisting of a tubular body 201, and front 202 and rear 203 end caps (FIG. 2). This housing is filled with mesh disks 204 that are compacted tightly into the internal volume of the tubular body 201 and held in place by the end caps 201, 202 (FIG. 2). Thermoelectric generators 208, 209, 210 are mounted on top of finned aluminum plates 205, 206, 207 (FIG. 2). The assemblages of thermoelectric generators and finned aluminum plates 208/205, 209/206, 210/207 are mounted flush with the top of the housing body 201 in recesses 211, 212, 213 that have centerline slits that allow the fins of the aluminum plates 205, 206, 207 to penetrate the internal volume of the alternator housing (FIG. 2).

Figure 3:
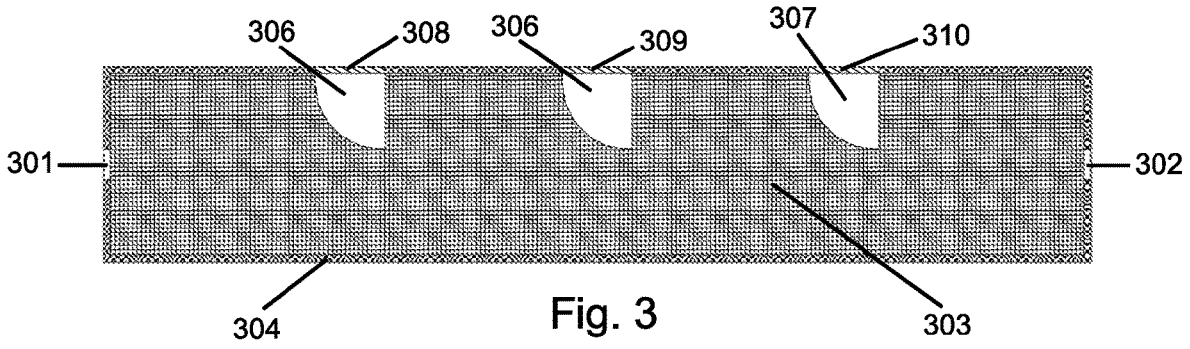
FIG. 3 is a side cross-section of the Mark I Firearm Alternator.
Figure 4:
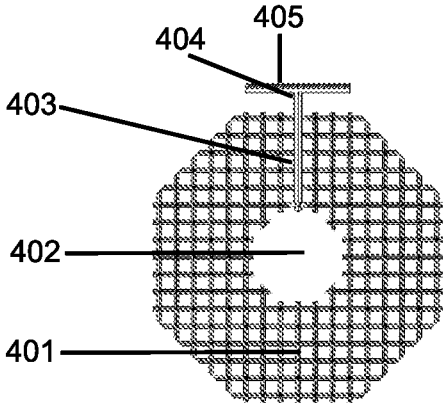
FIG. 4 is a front view of mesh disk and aluminum fin of the Mark I Firearm Alternator.
Figure 5:
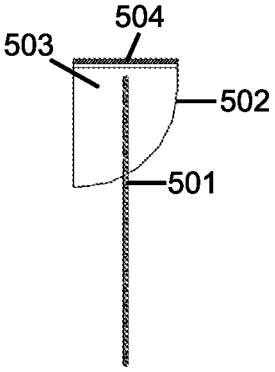
FIG. 5 is a side view of mesh disk and aluminum fin of the Mark I Firearm Alternator.

Internally, the alternator is filled with mesh disks 303 to provide a large surface area that absorbs heat from the gaseous discharge of a firearm as it is forced through the alternator from the barrel at the intake 302, to the exhaust 301 (FIG. 3). The mesh disks 401 have a central hole 402 to allow the unobstructed travel of a bullet through the alternator (FIG. 4). The mesh disks also have a single dorsal cut 403 which allows it to wrap tightly around the fin of the aluminum plate 404 that the thermoelectric generator(s) 405 are mounted to allowing the transmission of heat from the mesh to the generators 405 through the aluminum 404 (FIG. 4). The front edge of the aluminum fin 502 is curved and slightly pointed allowing the mesh disks 501 to slide over the aluminum fin easily, this makes the mesh disks easy to insert and remove from the alternator for cleaning, assembly and disassembly (FIG. 5).

The alternator housing 304 is insulating polymer, this forces all the heat from the gaseous discharge of a firearm to exit the alternator one of two ways: through the exhaust 301 or through the thermoelectric generators 308, 309, 310 via the aluminum mounting plates 305, 306, 307 (FIG. 3).

Figure 6:
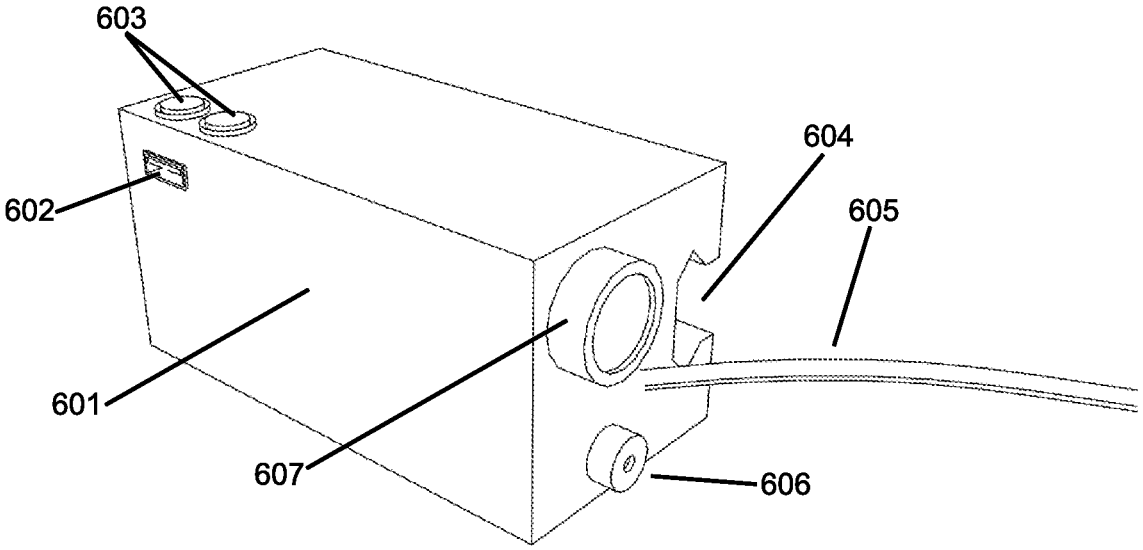
FIG. 6 is an isometric view of the Mark I Firearm Alternator Battery Box.

The electricity generated by the alternator is sent to an ultra-capacitor and battery housed in the battery box 601 via a connecting wire 605 from the battery box that plugs into the alternator (FIG. 6). The battery box is mounted to a firearm separate from the alternator (in one embodiment using a NATO standard rail system 604) to keep weight off the end of the firearm's barrel. The excess electrical energy stored in the battery box is controlled by buttons 603, in one embodiment of the invention, may be used to direct power to a flashlight 607, laser 606, or a USB port 602 (FIG. 6).

Figure 7:
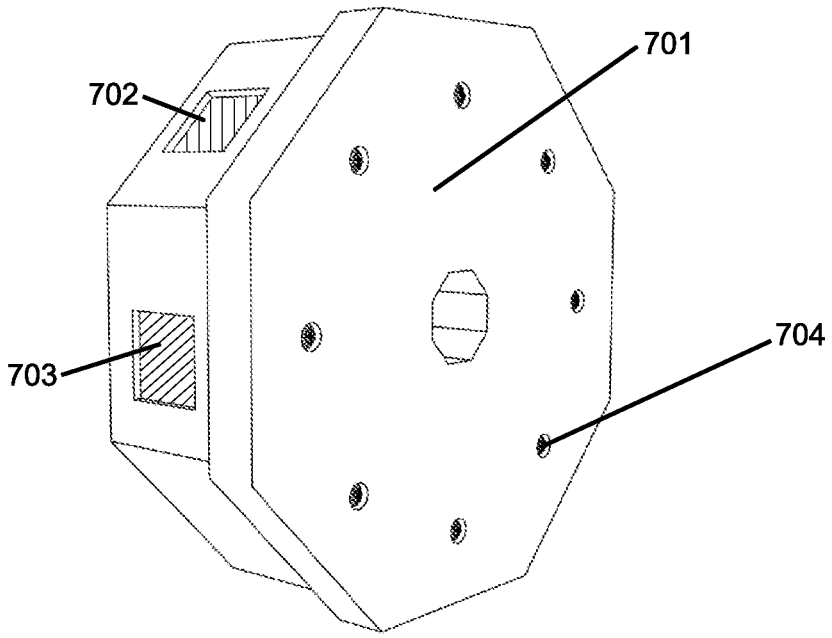
FIG. 7 is an isometric view of an alternate Battery end cap for the Mark I Firearm Alternator.

Alternatively, a small battery 703, and ultra-capacitor 702 may be placed in the rim of an enlarged front alternator end cap 701 and power, in one embodiment, a ring of LEDs 704 (FIG. 7). Providing a more compact alternative to the separate battery box/alternator embodiment of this invention.

Figure 8:
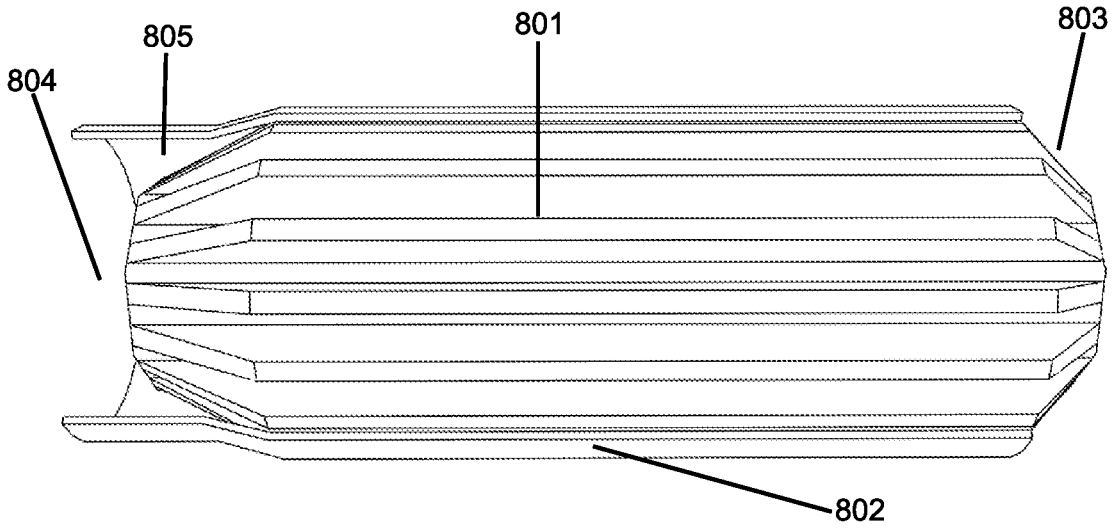
FIG. 8 is a cutaway side view of a radiator for the Mark I Firearm Alternator.

For greater efficiency a finned radiator 801 may be fitted around the exterior of the Firearm Alternator thereby increasing the effective surface area the Firearm Alternator's thermoelectric generators can use to cool their "cold" side (FIG. 8). In situations where rapid sustained fire from a firearm is expected, the radiator may be encased in a thin sleeve 802 which leaves the rear of the radiator 803 exposed to the environment while overhanging slightly 805 the muzzle 804 of the Firearm Alternator (FIG. 8). In this configuration the high velocity gas discharged from the muzzle of the Firearm Alternator 804 creates a low pressure area in the sleeve's 802 overhanging section 805 that draws air in from the rear of the radiator 803 and over the radiator's fins 801 cooling it and the cool side of the thermoelectric generators it covers (FIG. 8).

Upon review of the present disclosure, persons of ordinary skill in the art will realize that known techniques, apparatus, and instruments used in the industry may be: used to analyze, predict, design, and measure the combustion parameters and performance within the Firearm Alternator; chosen to fabricate the various components of the Firearm Alternator. Such components explicitly include the choice of materials, or choice of metals for the various seals, bearings and springs within the Firearm Alternator;

used to provide the welds necessary within the Firearm Alternator; and adapted to provide assembly and repair procedures for the Firearm Alternator.

1. Number of Firearm Alternators

In embodiments according the to present disclosure, a generator may possess any number of Firearm Alternators.

2. Firearm Alternator Using the Gaseous Discharge of a Firearm as a Working Fluid.

Any generator possessing at least one internal combustion engine which has any portion that uses the gaseous discharge of a firearm as a working fluid is a preferred embodiment of the invention.

Any generator possessing at least one external combustion engine which has any portion that uses the gaseous discharge of a firearm as a working fluid is a preferred embodiment of the invention.

Any generator possessing at least one heat exchanger which has any portion that uses the gaseous discharge of a firearm as a working fluid is a preferred embodiment of the invention.

Gaseous Discharge of a Firearm

The gaseous discharge of a firearm includes any chemical byproducts of the combustion of firearm propellant.

The gaseous discharge of a firearm includes any air accelerated by the combustion of firearm propellant.

The gaseous discharge of a firearm includes any air heated by the combustion of firearm propellant.

The gaseous discharge of a firearm includes any particulate matter created by to combustion of firearm propellant.

The gaseous discharge of a firearm includes any particulate matter accelerated by the combustion of firearm propellant that is not a part of the firearm projectile.

The gaseous discharge of a firearm includes any particulate matter heated by the combustion of firearm propellant that is not a part of the firearm projectile.

Working Fluid

A working fluid includes any gas that absorbs energy.

A working fluid includes any liquid that absorbs energy.

A working fluid includes any gas that transmits energy.

A working fluid includes any liquid that transmits energy.

A working fluid includes any gas that absorbs and transmits energy.

A working fluid includes any liquid that absorbs and transmits energy.

Turbines

An internal combustion engine includes any turbine that generates mechanical energy.

An external combustion engine includes any turbine that generates mechanical energy.

An internal combustion engine includes any turbine that generates mechanical energy through the deflection of a working fluid.

An external combustion engine includes any turbine that generates mechanical energy through the deflection of a working fluid.

An internal combustion engine includes any turbine that generates mechanical energy through the impingement of a working fluid.

An external combustion engine includes any turbine that generates mechanical energy through the impingement of a working fluid.

An internal combustion engine includes any turbine that generates mechanical energy through the deflection of a working fluid at any instant of its operation.

An external combustion engine includes any turbine that generates mechanical energy through the deflection of a working fluid at any instant of its operation.

An internal combustion engine includes any turbine that generates mechanical energy through the impingement of a working fluid during any portion of its operation.

An external combustion engine includes any turbine that generates mechanical energy through the impingement of a working fluid during any portion of its operation.

A preferred embodiment according to aspects of the present disclosure has at least one internal combustion engine turbine that uses the gaseous discharge of a firearm as a working fluid.

A preferred embodiment according to aspects of the present disclosure has at least one external combustion engine turbine that uses the gaseous discharge of a firearm as a working fluid.

Multiplicity of Turbines

Any generator possessing at least two internal combustion engine turbines which has any portion of the turbines that uses the gaseous discharge of a firearm as a working fluid is a preferred embodiment according to aspects of the present disclosure.

Any generator possessing at least two external combustion engine turbines which has any portion of the turbines that uses the gaseous discharge of a firearm as a working fluid is a preferred embodiment according to aspects of the present disclosure.

Any generator possessing a multiplicity of internal combustion engine turbines which has any portion of the turbines that uses the gaseous discharge of a firearm as a working fluid is a preferred embodiment according to aspects of the present disclosure, wherein the generator possesses a first internal combustion engine turbine and a second external combustion engine turbine, and wherein the first internal combustion engine turbine and second internal combustion engine turbine are geometrically concentric.

Any generator possessing a multiplicity of external combustion engine turbines which has any portion of the turbines that uses the gaseous discharge of a firearm as a working fluid is a preferred embodiment according to aspects of the present disclosure, wherein said generator possesses a first external combustion engine turbine and a second external combustion engine turbine, and wherein the first external combustion engine turbine and second external combustion engine turbine are geometrically concentric.

Any generator possessing a multiplicity of internal combustion engine turbines which has any portion of the turbines that uses the gaseous discharge of a firearm as a working fluid is a preferred embodiment according to aspects of the present disclosure, wherein the internal combustion engine turbines may have any three dimensional disposition and/or orientation with respect to one another.

Any generator possessing a multiplicity of external combustion engine turbines which has any portion of the turbines that uses the gaseous discharge of a firearm as a working fluid is a preferred embodiment according to aspects of the present disclosure, wherein the external combustion engine turbines may have any three dimensional disposition and/or orientation with respect to one another.

Pistons

An internal combustion engine includes any piston that generates mechanical energy.

An external combustion engine includes any piston that generates mechanical energy.

An internal combustion engine includes any piston that generates mechanical energy through the deflection of a working fluid.

An external combustion engine includes any piston that generates mechanical energy through the deflection of a working fluid.

An internal combustion engine includes any piston that generates mechanical energy through the impingement of a working fluid.

An external combustion engine includes any piston that generates mechanical energy through the impingement of a working fluid.

An internal combustion engine includes any piston that generates mechanical energy through the deflection of a working fluid at any instant of its operation.

An external combustion engine includes any piston that generates mechanical energy through the deflection of a working fluid at any instant of its operation.

An internal combustion engine includes any piston that generates mechanical energy through the impingement of a working fluid during any portion of its operation.

An external combustion engine includes any piston that generates mechanical energy through the impingement of a working fluid during any portion of its operation.

A preferred embodiment according to aspects of the present disclosure has at least one internal combustion engine piston that uses the gaseous discharge of a firearm as a working fluid.

A preferred embodiment according to aspects of the present disclosure has at least one external combustion engine piston that uses the gaseous discharge of a firearm as a working fluid.

Multiplicity of Pistons

Any generator possessing at least two internal combustion engine pistons which has any portion of the pistons that uses the gaseous discharge of a firearm as a working fluid is a preferred embodiment according to aspects of the present disclosure.

Any generator possessing at least two external combustion engine pistons which has any portion of the pistons that uses the gaseous discharge of a firearm as a working fluid is a preferred embodiment according to aspects of the present disclosure.

Any generator possessing a multiplicity of internal combustion engine pistons which has any portion of the pistons that uses the gaseous discharge of a firearm as a working fluid is a preferred embodiment according to aspects of the present disclosure, wherein said generator possesses a first internal combustion engine piston and a second internal combustion engine piston, and wherein said first internal combustion engine piston and second internal combustion engine piston are geometrically concentric.

Any generator possessing a multiplicity of external combustion engine pistons which has any portion of the pistons that uses the gaseous discharge of a firearm as a working fluid is a preferred embodiment according to aspects of the present disclosure, wherein said generator possesses a first external combustion engine piston and a second external combustion engine piston, and wherein the first external combustion engine piston and second external combustion engine piston are geometrically concentric.

Any generator possessing a multiplicity of internal combustion engine pistons which has any portion of the pistons that uses the gaseous discharge of a firearm as a working fluid is a preferred embodiment according to aspects of the present disclosure, wherein the internal combustion engine pistons may have any three dimensional disposition and/or orientation with respect to one another.

Any generator possessing a multiplicity of external combustion engine pistons which has any portion of the pistons that uses the gaseous discharge of a firearm as a working fluid is a preferred embodiment according to aspects of the present disclosure, wherein the external combustion engine pistons may have any three dimensional disposition and/or orientation with respect to one another.

Nozzles

An internal combustion engine includes any nozzle that generates mechanical energy.

An external combustion engine includes any nozzle that generates mechanical energy.

An internal combustion engine includes any nozzle that generates mechanical energy through the expulsion of a working fluid.

An external combustion engine includes any nozzle that generates mechanical energy through the expulsion of a working fluid.

An internal combustion engine includes any nozzle that generates mechanical energy through the expulsion of a working fluid at any instant of its operation.

An external combustion engine includes any nozzle that generates mechanical energy through the expulsion of a working fluid at any instant of its operation.

An internal combustion engine includes any nozzle that generates mechanical energy through the expulsion of a working fluid during any portion of its operation.

An external combustion engine includes any nozzle that generates mechanical energy through the expulsion of a working fluid during any portion of its operation.

A preferred embodiment according to aspects of the present disclosure has at least one internal combustion engine nozzle that uses the gaseous discharge of a firearm as a working fluid.

A preferred embodiment according to aspects of the present disclosure has at least one external combustion engine nozzle that uses the gaseous discharge of a firearm as a working fluid.

Multiplicity of Nozzles

Any generator possessing at least two internal combustion engine nozzles which has any portion of the nozzles that uses the gaseous discharge of a firearm as a working fluid is a preferred embodiment according to aspects of the present disclosure.

Any generator possessing at least two external combustion engine nozzles which has any portion of the nozzles that uses the gaseous discharge of a firearm as a working fluid is a preferred embodiment according to aspects of the present disclosure.

Any generator possessing a multiplicity of internal combustion engine nozzles which has any portion of the nozzles that uses the gaseous discharge of a firearm as a working fluid is a preferred embodiment according to aspects of the present disclosure, wherein the internal combustion engine nozzles may have any three dimensional disposition and/or orientation with respect to one another.

Any generator possessing a multiplicity of external combustion engine nozzles which has any portion of the nozzles that uses the gaseous discharge of a firearm as a working fluid is a preferred embodiment according to aspects of the present disclosure, wherein the external combustion engine nozzles may have any three dimensional disposition and/or orientation with respect to one another.

Indirect Contact Working Fluid and Solid Heat Exchanger

A heat exchanger includes any material that allows the transfer of thermal energy between two separated mediums, wherein one medium is a working fluid and the other medium is a solid.

A heat exchanger includes any material that allows the transfer of thermal energy between two separated mediums that is designed to transfer thermal energy between two separated mediums at any instant of its operation, wherein one medium is a working fluid and the other medium is a solid.

A heat exchanger includes any material that allows the transfer of thermal energy between two separated mediums that is designed to transfer thermal energy between two separated mediums during any portion of its operation, wherein one medium is a working fluid and the other medium is a solid.

A preferred embodiment of the invention has at least one heat exchanger fabricated from any material that allows the transfer of thermal energy between two separated mediums, wherein one medium is the gaseous discharge of a firearm as a working fluid and the other medium is a solid.

Indirect Contact Working Fluid and Liquid Heat Exchanger

A heat exchanger includes any material that allows the transfer of thermal energy between two separated mediums, wherein one medium is a working fluid and the other medium is a liquid.

A heat exchanger includes any material that allows the transfer of thermal energy between two separated mediums that is designed to transfer thermal energy between two separated mediums at any instant of its operation, wherein one medium is a working fluid and the other medium is a liquid.

A heat exchanger includes any material that allows the transfer of thermal energy between two separated mediums that is designed to transfer thermal energy between two separated mediums during any portion of its operation, wherein one medium is a working fluid and the other medium is a liquid.

A preferred embodiment of the invention has at least one heat exchanger fabricated from any material that allows the transfer of thermal energy between two separated mediums, wherein one medium is the gaseous discharge of a firearm as a working fluid and the other medium is a liquid.

Indirect Contact Working Fluid and Gas Heat Exchanger

A heat exchanger includes any material that allows the transfer of thermal energy between two separated mediums, wherein one medium is a working fluid and the other medium is a gas.

A heat exchanger includes any material that allows the transfer of thermal energy between two separated mediums that is designed to transfer thermal energy between two separated mediums at any instant of its operation, wherein one medium is a working fluid and the other medium is a gas.

A heat exchanger includes any material that allows the transfer of thermal energy between two separated mediums that is designed to transfer thermal energy between two separated mediums during any portion of its operation, wherein one medium is a working fluid and the other medium is a gas.

A preferred embodiment according to aspects of the present disclosure has at least one heat exchanger fabricated from any material that allows the transfer of thermal energy between two separated mediums, wherein one medium is the gaseous discharge of a firearm as a working fluid and the other medium is a gas.

Indirect Contact Working Fluid and Working Fluid Heat Exchanger

A heat exchanger includes any material that allows the transfer of thermal energy between two separated mediums, wherein both of those mediums are working fluids.

A heat exchanger includes any material that allows the transfer of thermal energy between two separated mediums that is designed to transfer thermal energy between two separated mediums at any instant of its operation, wherein both of those mediums are working fluids.

A heat exchanger includes any material that allows the transfer of thermal energy between two separated mediums that is designed to transfer thermal energy between two separated mediums during any portion of its operation, wherein both of those mediums are working fluids.

A preferred embodiment according to aspects of the present disclosure has at least one heat exchanger fabricated from any material that allows the transfer of thermal energy between two separated mediums, wherein one medium is the gaseous discharge of a firearm as a working fluid and the other medium is a working fluid.

Multiplicity of Indirect Contact Heat Exchangers

Any generator possessing at least two indirect contact heat exchangers which has any portion of the heat exchangers that uses the gaseous discharge of a firearm as a working fluid is a preferred embodiment according to aspects of the present disclosure.

Any generator possessing a multiplicity of indirect contact heat exchangers which has any portion of the heat exchangers that uses the gaseous discharge of a firearm as a working fluid is a preferred embodiment according to aspects of the present disclosure, wherein said generator possesses a first indirect contact heat exchanger and a second indirect contact heat exchanger, and wherein the first indirect contact heat exchanger and second indirect contact heat exchanger are geometrically concentric.

Any generator possessing a multiplicity of indirect contact heat exchangers which has any portion of the heat exchangers that uses the gaseous discharge of a firearm as a working fluid is a preferred embodiment according to aspects of the present disclosure, wherein the indirect contact heat exchangers may have any three dimensional disposition and/or orientation with respect to one another.

Direct Contact Working Fluid and Solid Heat Exchanger

A heat exchanger includes any process/enclosure that facilitates the transfer of thermal energy between two unseparated mediums in different phases of matter, wherein one medium is a working fluid and the other medium is a solid.

A heat exchanger includes any process/enclosure that facilitates the transfer of thermal energy between two unseparated mediums in different phases of matter at any instant of its operation, wherein one medium is a working fluid and the other medium is a solid.

A heat exchanger includes any process/enclosure that facilitates the transfer of thermal energy between two unseparated mediums in different phases of matter during any portion of its operation, wherein one medium is a working fluid and the other medium is a solid.

A heat exchanger includes any enclosure that facilitates the transfer of thermal energy between two unseparated mediums in different phases of matter, wherein one medium is a working fluid and the other medium is a solid.

A heat exchanger includes any enclosure that facilitates the transfer of thermal energy between two unseparated mediums in different phases of matter at any instant of its operation, wherein one medium is a working fluid and the other medium is a solid.

A heat exchanger includes any enclosure that facilitates the transfer of thermal energy between two unseparated mediums in different phases of matter during any portion of its operation, wherein one medium is a working fluid and the other medium is a solid.

A preferred embodiment according to aspects of the present disclosure has at least one heat exchanger, fabricated from any material, that facilitates the transfer of thermal energy between two unseparated mediums in different phases of matter, wherein one medium is the gaseous discharge of a firearm as a working fluid and the other medium is a solid.

Direct Contact Working Fluid and Liquid Heat Exchanger

A heat exchanger includes any process that facilitates the transfer of thermal energy between two unseparated mediums in different phases of matter, wherein one medium is a working fluid and the other medium is a liquid.

A heat exchanger includes any process that facilitates the transfer of thermal energy between two unseparated mediums in different phases of matter at any instant of its operation, wherein one medium is a working fluid and the other medium is a liquid.

A heat exchanger includes any process that facilitates the transfer of thermal energy between two unseparated mediums in different phases of matter during any portion of its operation, wherein one medium is a working fluid and the other medium is a liquid.

A heat exchanger includes any enclosure that facilitates the transfer of thermal energy between two unseparated mediums in different phases of matter, wherein one medium is a working fluid and the other medium is a liquid.

A heat exchanger includes any enclosure that facilitates the transfer of thermal energy between two unseparated mediums in different phases of matter at any instant of its operation, wherein one medium is a working fluid and the other medium is a liquid.

A heat exchanger includes any enclosure that facilitates the transfer of thermal energy between two unseparated mediums in different phases of matter during any portion of its operation, wherein one medium is a working fluid and the other medium is a liquid.

A preferred embodiment according to aspects of the present disclosure has at lest one heat exchanger, fabricated from any material, that facilitates the transfer of thermal energy between two unseparated mediums in different phases of matter, wherein one medium is the gaseous discharge of a firearm as a working fluid and the other medium is a liquid.

Direct Contact Working Fluid and Gas Heat Exchanger

A heat exchanger includes any process that facilitates the transfer of thermal energy between two unseparated mediums in different phases of matter, wherein one medium is a working fluid and the other medium is a gas.

A heat exchanger includes any process that facilitates the transfer of thermal energy between two unseparated mediums in different phases of matter at any instant of its operation, wherein one medium is a working fluid and the other medium is a gas.

A heat exchanger includes any process that facilitates the transfer of thermal energy between two unseparated mediums in different phases of matter during any portion of its operation, wherein one medium is a working fluid and the other medium is a gas.

A heat exchanger includes any enclosure that facilitates the transfer of thermal energy between two unseparated mediums in different phases of matter, wherein one medium is a working fluid and the other medium is a gas.

A heat exchanger includes any enclosure that facilitates the transfer of thermal energy between two unseparated mediums in different phases of matter at any instant of its operation, wherein one medium is a working fluid and the other medium is a gas.

A heat exchanger includes any enclosure that facilitates the transfer of thermal energy between two unseparated mediums in different phases of matter during any portion of its operation, wherein one medium is a working fluid and the other medium is a gas.

A preferred embodiment according to aspects of the present disclosure has at least one heat exchanger, fabricated from any material, that facilitates the transfer of thermal energy between two unseparated mediums in different phases of matter, wherein one medium is the gaseous discharge of a firearm as a working fluid and the other medium is a gas.

Direct Contact Working Fluid and Working Fluid Heat Exchanger

A heat exchanger includes any process that facilitates the transfer of thermal energy between two unseparated mediums in different phases of matter, wherein both of those mediums are working fluids.

A heat exchanger includes any process that facilitates the transfer of thermal energy between two unseparated mediums in different phases of matter at any instant of its operation, wherein both of those mediums are working fluids.

A heat exchanger includes any process that facilitates the transfer of thermal energy between two unseparated mediums in different phases of matter during any portion of its operation, wherein both of those mediums are working fluids.

A heat exchanger includes any enclosure that facilitates the transfer of thermal energy between two unseparated mediums in different phases of matter, wherein both of those mediums are working fluids.

A heat exchanger includes any enclosure that facilitates the transfer of thermal energy between two unseparated mediums in different phases of matter at any instant of its operation, wherein both of those mediums are working fluids.

A heat exchanger includes any enclosure that facilitates the transfer of thermal energy between two unseparated mediums in different phases of matter during any portion of its operation, wherein both of those mediums are working fluids.

A preferred embodiment according to aspects of the present disclosure has at lest one heat exchanger, fabricated from any material, that facilitates the transfer of thermal energy between two unseparated mediums in different phases of matter, wherein one medium is the gaseous discharge of a firearm as a working fluid and the other medium is a working fluid.

Multiplicity of Direct Contact Heat Exchangers

Any generator possessing at least two direct contact heat exchangers which has any portion of the heat exchangers that uses the gaseous discharge of a firearm as a working fluid is a preferred embodiment according to aspects of the present disclosure.

Any generator possessing a multiplicity of direct contact heat exchangers which has any portion of the heat exchangers that uses the gaseous discharge of a firearm as a working fluid is a preferred embodiment according to aspects of the present disclosure, wherein said generator possesses a first direct contact heat exchanger and a second direct contact heat exchanger, and wherein the first direct contact heat exchanger and second direct contact heat exchanger are geometrically concentric.

Any generator possessing a multiplicity of direct contact heat exchangers which has any portion of the heat exchangers that uses the gaseous discharge of a firearm as a working fluid is a preferred embodiment according to aspects of the present disclosure, wherein the direct contact heat exchangers may have any three dimensional disposition and/or orientation with respect to one another.

3. Components of a Firearm Alternator

Any generator possessing at least one Firearm Alternator that has at least one housing component, one engine component, one electrical generating component, and one electrical storage component (capacitor and/or battery) is a preferred embodiment according to aspects of the present disclosure.

Any generator possessing at least one Firearm Alternator that has at least one housing component, one engine component, one electrical generating component, one electrical storage component (capacitor and/or battery), and one electrical load component is a preferred embodiment according to aspects of the present disclosure.

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component.

In a preferred embodiment according to aspects of the present disclosure, the housing component is comprised of one or more individual housing components.

In a preferred embodiment according to aspects of the present disclosure, the engine component is comprised of one or more individual engine components.

In a preferred embodiment according to aspects of the present disclosure, the electrical generating component is comprised of one or more individual generating components.

In a preferred embodiment according to aspects of the present disclosure, the electrical storage component is comprised of one or more individual storage components.

In a preferred embodiment according to aspects of the present disclosure, the electrical load component is comprised of one or more individual load components.

In one preferred embodiment of the invention according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said engine component is one or more turbines.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby said engine component is one or more turbines.

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said engine component is one or more pistons.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby the engine component is one or more pistons.

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby the engine component is one or more nozzles.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby the engine component is one or more nozzles.

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said engine component is one or more nozzles which execute linear motion.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby the engine component is one or more nozzles which execute linear motion.

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said engine component is one or more nozzles which execute rotational motion.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby the engine component is one or more nozzles which execute rotational motion.

Thermal Based Generation

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby the engine component is one or more heat exchangers and the electrical generating component is one or more thermoelectric generators.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into electrical energy which is then transmitted to the electrical storage component, electrical energy from the electrical storage component is then transmitted to the electrical load component, whereby said engine component is one or more heat exchangers and said electrical generating component is one or more thermoelectric generators.

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said engine component is one or more heat exchangers and said electrical generating component is one or more thermogalvanic cells.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into electrical energy which is then transmitted to the electrical storage component, electrical energy from the electrical storage component is then transmitted to the electrical load component, whereby said engine component is one or more heat exchangers and said electrical generating component is one or more thermogalvanic cells.

Magnetohydrodynamic Based Generation

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said engine component is one or more nozzles and said electrical generating component is one or more magnetohydrodynamic generators.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby said engine component is one or more nozzles and said electrical generating component is one or more magnetohydrodynamic generators.

4. Attachment of Components

In one preferred embodiment according to aspects of the present disclosure, the engine component is attached to the electrical generating component, and the combined engine component and electrical generating component executes rotational motion.

In one preferred embodiment according to aspects of the present disclosure, the engine component is attached to the electrical generating component, and the combined engine component and electrical generating component executes linear motion.

In one preferred embodiment according to aspects of the present disclosure, the engine component is attached to the electrical generating component, and the combined engine component and electrical generating component executes no motion.

In one preferred embodiment according to aspects of the present disclosure, the engine component is attached to the electrical generating component, and the combined engine component and electrical generating component executes motion with respect to one another.

In one preferred embodiment according to aspects of the present disclosure, the engine component is non-rigidly attached to the electrical generating component, and the combined engine component and electrical generating component executes motion with respect to one another.

Methods of Attachment to a Firearm

In one preferred embodiment according to aspects of the present disclosure, the Firearm Alternator is non-permanently attached to the end of a firearm's barrel, and the combined firearm and Firearm Alternator are oriented to allow the safe discharge of the firearm.

In one preferred embodiment according to aspects of the present disclosure, the Firearm Alternator is permanently attached to the end of a firearm's barrel, and the combined firearm and Firearm Alternator are oriented to allow the safe discharge of the firearm.

In one preferred embodiment according to aspects of the present disclosure, the Firearm Alternator is non-permanently attached to the end of a firearm's receiver, and the combined firearm and Firearm Alternator are oriented to allow the safe discharge of the firearm while the barrel expels its gaseous discharge into the Firearm Alternator.

In one preferred embodiment according to aspects of the present disclosure, the Firearm Alternator is permanently attached to the end of a firearm's receiver, and the combined firearm and Firearm Alternator are oriented to allow the safe discharge of the firearm while the barrel expels its gaseous discharge into the Firearm Alternator.

In one preferred embodiment according to aspects of the present disclosure, the Firearm Alternator is non-permanently attached to a muzzle device, the muzzle device is non-permanently attached to a firearm, and the combined firearm, muzzle device, and Firearm Alternator are oriented to allow the safe discharge of the firearm.

In one preferred embodiment according to aspects of the present disclosure, the Firearm Alternator is non-permanently attached to a muzzle device, the muzzle device is permanently attached to a firearm, and the combined firearm, muzzle device, and Firearm Alternator are oriented to allow the safe discharge of the firearm.

In one preferred embodiment according to aspects of the present disclosure, the Firearm Alternator is non-permanently attached to a firearm suppressor, the firearm suppressor is non-permanently attached to a firearm, and the combined firearm, firearm suppressor, and Firearm Alternator are oriented to allow the safe discharge of the firearm.

In one preferred embodiment according to aspects of the present disclosure, the Firearm Alternator is non-permanently attached to a firearm suppressor, the firearm suppressor is permanently attached to a firearm, and the combined firearm, firearm suppressor, and Firearm Alternator are oriented to allow the safe discharge of the firearm.

5. Any Motion

The engine may make any motion with respect to the path of a projectile provided that the engine uses the gaseous discharge of a firearm during at least a portion of that motion.

6. Disposition and Orientation of Components

Components of a Firearm Alternator may have any three dimensional disposition and/or orientation with respect to the path of a projectile so long as the projectile's travel remains unobstructed.

7. Seals

In one preferred embodiment according to aspects of the present disclosure, the engine component is comprised of one or more individual engine components, where the volume(s) between engine component(s) are separated by a wall(s) made from any material which has self-sealing properties, which allow the safe passage of a projectile.

8. Valves and Nozzles

In one preferred embodiment according to aspects of the present disclosure, the engine component is comprised of one or more individual engine components, where the volume(s) between engine component(s) is subject to the passage of gaseous firearm discharge controlled by a valve(s) and/or nozzle(s), which restricts the passage of gaseous firearm discharge without restricting the passage of a projectile.

9. Electrical Loads

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into electrical energy which is then transmitted to the electrical storage component, electrical energy from the electrical storage component is then transmitted to the electrical load component, whereby said electrical load component is one or more electrical devices.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into electrical energy which is then transmitted to the electrical storage component, electrical energy from the electrical storage component is then transmitted to the electrical load component, whereby said electrical load component is one or more connector(s) to electrical devices.

10. Electrical Storage

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said electrical storage component is a combination of one or more batteries and capacitors.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby said electrical storage component is a combination of one or more batteries and capacitors.

Batteries

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said electrical storage component is one or more batteries.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby said electrical storage component is one or more batteries.

Capacitors

In one preferred embodiment according to aspects of the present disclosure, the engine component is rigidly attached to the electrical generating component, the electrical generating component is electrically attached to the electrical storage component, the housing component is rigidly attached to a firearm, and the combined engine component and electrical generating component converts the energy of a gaseous firearm discharge into mechanical and then electrical energy which is then transmitted to the electrical storage component, whereby said electrical storage component is one or more capacitors.

In one preferred embodiment according to aspects of the present disclosure, the engine component is rigidly attached to the electrical generating component, the electrical generating component is electrically attached to the electrical storage component, the electrical storage component is electrically attached to the electrical load component, the housing component is rigidly attached to a firearm, and the combined engine component and electrical generating component converts the energy of a gaseous firearm discharge into mechanical and then electrical energy which is then transmitted to the electrical storage component, electrical energy from the electrical storage component is then transmitted to the electrical load component, whereby the electrical storage component is one or more capacitors.

While the above description contains many specificities, those should not be construed as limitations on the scope of the invention, but rather as an exemplification of preferred embodiments thereto. As have been briefly described there are many possible variations. Accordingly, the scope of the inventions should be determined not only by the embodiments illustrated, but by the appended claims and their legal equivalents.

The specification and drawings herein are, accordingly, to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed invention is susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions and equivalents falling within the spirit and scope of the disclosure, as defined in the appended sample claims.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without other input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Embodiments of this disclosure are described herein, including the best mode known to the inventors for carrying out the disclosure. Variations of these embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A generator apparatus for the generating of electrical energy, which apparatus is attached to a firearm that is the source of high energy gaseous discharge to the generator apparatus, comprising:

an alternator having a housing, a first end, a second end spaced from the first end and at least one internal cavity between the first and second ends, a first aperture disposed in the first end and a second aperture disposed in the second end, the dimension between the first and second apertures defining the longitudinal axis of the housing, the housing adapted to attach to the firearm such that the gaseous discharge from the muzzle enters the at least one cavity;

at least one heat exchanger disposed in the cavity;

at least one thermoelectric generator attached to and in thermal communication with the at least one heat exchanger; and a power storage device electrically connected to the thermoelectric generator.

2. The generator apparatus of claim 1, wherein the at least one heat exchanger comprises at least one metal member disposed in the cavity perpendicular with the longitudinal axis and does not obstruct a linear path between the first and second apertures.

3. The generator apparatus of claim 1, wherein the at least one heat exchanger comprises at least one metal member disposed in the cavity perpendicular with the longitudinal axis and having a central aperture aligned with the first and second apertures.

4. The generator apparatus of claim 3, wherein the at least one heat exchanger further comprises at least one heat sink, and wherein the at least one heat sink comprises first metal plate having a first side and a second side and the thermoelectric generator is in thermal communication with the first side and the second side is in thermal communication with the interior of at least one of the at least one cavity.

5. The generator apparatus of claim 4, further comprising a thermoelectric generator connected to the first side of each of the at least one first metal plates.

6. The generator apparatus of claim 4, wherein the at least one heat sink further comprises a metal member extending from inside of at least one of the at least one cavity to contact the second side of the first metal plate.

7. The generator apparatus of claim 4, wherein the at least one heat sink further comprises a second metal plate extending from the second side of the first metal plate into at least one of the at least one cavity.

8. The generator of claim 7, wherein the second metal plate contacts at least one metal member.

9. The generator apparatus of claim 8, wherein the at least one metal member comprises a plurality of metal mesh screens.

10. The generator apparatus of claim 9, wherein at least some of the metal mesh screens have a slot configured to receive the second metal plate of at least one of the at least one first metal plates.

11. The generator apparatus of claim 1, wherein the heat exchanger comprises a portion of a thermoelectric generator in thermal communication with the at least one cavity.

12. The generator apparatus of claim 1, wherein the apparatus housing comprises an insulator.

13. The generator apparatus of claim 1, wherein the power storage device is at least one of one or more batteries and one or more capacitors.

14. The generator apparatus of claim 1, further comprising a first cavity with a first heat sink and a second cavity with a second heat sink.

15. The generator apparatus of claim 1, wherein the first heat sink is a mesh lining the first cavity and the second heat sink is a plurality of mesh screens.

16. The generator apparatus of claim 1, further comprising a radiator positioned in thermal conductivity with the exterior of the alternator housing.

17. The generator apparatus of claim 16, wherein the radiator comprises one or more fins.

18. The generator apparatus of claim 17, wherein the at least one thermoelectric generator is in thermal communication with the at least one or more fins.

19. A method to generate electrical energy by using the gaseous discharge of a firearm as a working fluid of a generator assembly comprising at least the following steps:

a. attaching a generator assembly to a muzzle of a firearm;
b. providing relatively high energy fluid, in the form of the gaseous discharge of a firearm, from the muzzle of a firearm to said generator assembly;
c. passing a portion of said high energy fluid through an engine to serve as said engine's working fluid, wherein the engine is at least one heat exchanger;
d. conversion of working fluid energy to thermal energy by said engine;
e. passing a portion of said thermal energy from said engine to a thermoelectric generator; and
f. conversion of said thermal energy to electrical energy by said thermoelectric generator.

20. The method of claim 19, wherein the at least one heat exchanger is at least one heat sink, and conversion of the working fluid energy to a useful form comprises the at least one heat sink absorbing the kinetic energy of the gaseous discharge.

21. The method of claim 19, further comprising storing the electrical energy.

22. The method of claim 19, wherein the at least one heat exchanger is at least one heat sink, and conversion of the working fluid energy to thermal energy comprises the at least one heat sink absorbing the heat of the gaseous discharge.

23. The method of claim 22, wherein the thermoelectric generator comprises a plurality of thermoelectric generators in thermal communication with the at least one heat exchanger and passing a portion of said thermal energy from said engine to said thermoelectric generator comprises conducting heat to the plurality of thermoelectric generators through the at least one heat exchanger.

24. The method of claim 22, wherein conversion of thermal energy to electric energy comprises the one or more thermoelectric generators converting heat to electrical energy.

25. The method of claim 22, further comprising storing the electrical energy in a storage device.

26. The method of claim 25, wherein the storage device is at least one of the group comprising one or more batteries, one or more capacitors and one or more ultracapacitors.

* * * * *